US006948831B1

(12) United States Patent
Naqvi

(10) Patent No.: US 6,948,831 B1
(45) Date of Patent: Sep. 27, 2005

(54) RECESSED LIGHT ASSEMBLY ADAPTED FOR USE WITH MOTION DETECTOR

(76) Inventor: Shams Naqvi, 5210 Cutter La., El Sobrnate, CA (US) 94803

( * ) Notice: Subject to any disclaimer, the term of this patent is extended or adjusted under 35 U.S.C. 154(b) by 59 days.

(21) Appl. No.: 10/759,032

(22) Filed: Jan. 20, 2004

(51) Int. Cl.[7] ..... F21S 1/02
(52) U.S. Cl. ..... 362/276; 362/365; 362/148; 362/802
(58) Field of Search ..... 362/148, 150, 362/276, 802, 365

(56) References Cited

U.S. PATENT DOCUMENTS

| | | | | |
|---|---|---|---|---|
| 2,736,894 | A | 2/1956 | Kock | |
| 4,258,255 | A | 3/1981 | Guscott | |
| 4,982,176 | A | 1/1991 | Schwarz | |
| 5,282,118 | A | 1/1994 | Lee | |
| 5,626,417 | A | 5/1997 | McCavit | |
| RE35,534 | E | 6/1997 | Claytor | |
| 6,364,510 | B1 * | 4/2002 | Bernhart et al. | 362/365 |
| 2005/0024856 | A1 * | 2/2005 | Helenowski | 362/147 |

* cited by examiner

*Primary Examiner*—Ali Alavi

(57) ABSTRACT

A recessed lighting assembly is adapted to be integrated with a motion detector subassembly, photoelectric cell, and an electronic timer. The motion detector subassembly includes motion detector sensor(s), a focusing device and a decorative shield over focusing device. Motion detector subassembly is generally disposed inside the decorative trim. The required conditions for allowing electrical power to reach said electric lamp are the presence of line electric current, detection by motion detector subassembly of infrared radiation attributable to human and/or animal presence, and a lack of ambient light as measured by said photoelectric cell. Said electronic timer controls the amount of time the electric lamp contained in said recessed lighting assembly is allowed to remain on once it is turned on. Such recessed light assembly is to be used for the purpose of providing convenience, savings on electricity consumption, and security of premises. Different embodiments of the Recessed Light Assembly are presented and these include the complete Recessed Light Assembly, a stripped down, Slidable Recessed Light Assembly, a Recessed Light Assembly Trim & Motion Detector Assembly, and a Recessed Light Assembly Trim with all electronics surface mounted and all circuits etched directly on the inside of the said trim.

16 Claims, 6 Drawing Sheets

RECESSED LIGHT ASSEMBLY ADAPTED FOR USE WITH MOTION DETECTOR

CROSS-REFERENCE TO RELATED APPLICATIONS

Not Applicable.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISK APPENDIX

Not Applicable.

BACKGROUND OF THE INVENTION

1. Field of the Invention

The present invention generally relates to the field of motion-sensed activation of an electrical lamp, and in particular, it relates to an integrated assembly of motion-sensing electronics, optics, and an electrical lamp fixture that is adapted for installation in a recess or a cavity in ceilings or on walls.

2. Description of the Related Art

Activation of electrical lamp based on the detection of human motion is commonly used as a security arrangement. In a large number of installations, this arrangement is also used to conserve electricity. In both applications, electrical lamp remains turned off until light needs to be turned on for humans approaching an area covered by a motion detector, which, upon sensing human-source infrared radiation, releases electrical current to the lamp. Electrical power remains available to the lighting fixture at all times, but it is the motion and ambient light sensors and associated logic circuits which determine if and when to turn the lights on.

Lights that are activated by motion detector(s) generally include a pair of passive infrared sensors disposed within the motion detector's housing. PIR sensors detect infrared radiation emitted by objects that generate heat, including humans who emit infrared radiation that is strongest at a wavelength of 9.4 micrometer. To respond only to the movement of humans, all wavelengths outside of the band of interest, typically the 8–14 micrometer band, are electronically filtered out. A typical motion detector responds to the movement of humans by generating a small electrical charge that is further conditioned to switch on electrical current to a lamp(s) within the electrical light assembly that is to be activated by the motion detector. Motion detectors generally consist of a pair of motion sensors made of pyro-electric material. A focusing device is also installed within the motion detector subassembly to focus incoming IR radiation to one or the other sensor in the PIR sensor pair. The most commonly used focusing device is a Fresnel lens, though other devices such as a shadow lens consisting of baffle strips are also in common use. PIR, IR and focusing devices including Fresnel lens are widely covered in various disclosures, such as U.S. Pat. No. 4,258,255 for PIR devices and U.S. Pat. No. 2,736,894, RE035,534 and others for Fresnel lens type of focusing devices.

Decorative and security lamps with integral or electromechanically attached motion sensors are relatively well known in the art. Examples of such lamps are disclosed in U.S. Pat. Nos. 4,982,176 and 5,282,118. Decorative lamps come in a variety of designs: there are security lights in which the electrical lamp(s) and PIR motion sensor assembly are physically detached but electrically connected; also available are fully integrated units such as a coach lantern design disclosed in U.S. Pat. No. 5,626,417. Virtually all such units in current use have logic circuits within the lamp assembly, which logic circuits determine when electrical current needs to be applied to the electrical lamp contained within the assembly. That determination derives from such inputs as ambient light and the intensity and rate of change in infrared energy.

In certain installations where a plurality of electrical lamps needs to be operated in a single electrical wiring circuit, each lamp may be fitted with its own motion sensor. Alternately, a single motion sensor may be configured to power up the entire electrical circuit that in turn powers up all lamps in the circuit.

A problem arises when a recessed light assembly is to be installed in conjunction with a motion detector. Currently available recessed light assemblies require that the motion detector subassembly be installed separately with significant effort while the end result is aesthetically unpleasant. The issue remains unchanged even when a single electrical switch controls power to a recessed light assembly and to a non-recessed lamp with an integrated motion detector subassembly. This type of circuitry is common in many North American homes where a single electrical switch controls electric power to decorative lantern(s) installed at curbside or near garage door, as well as to recess light(s) installed in a patio at front entrance. The problem with such combination lighting circuits is that they power up only when the motion sensor in the decorative lighting fixture detects motion, but not when humans approach the recessed light, such as when exiting the home from the front entrance. This disadvantage renders such installations partly or completely ineffective. It is possible to equip the recessed light(s) with a standard standalone motion detector; however, that would be aesthetically unpleasant. Thus, it is evident that the recessed light must have its own motion detector for the entire circuit to function properly.

Along with the aesthetics aspect noted above, installation of a standalone motion sensor with a recessed lighting fixture is cumbersome and expensive, as it requires cutting into wood, stucco, and/or brick construction materials to lay down wiring and to install the additional motion detector subassembly.

Yet another problem with the use of a standalone motion sensor is the design of the Fresnel lens that is more suited for a motion detector subassembly which stands out, or sticks out, from the mounting surface. Such a configuration is not best suited for a recessed light since recessed lights are generally installed in ceilings.

In view of the issues cited above, there exists a need for a recessed light assembly integrated with a motion detector in an aesthetically pleasant and functionally correct housing.

SUMMARY OF THE INVENTION

It is the object of the present invention to provide a motion sensor activated electrical lamp assembly adapted for installation inside a structural recess.

In one aspect, the present invention provides within a recessed light assembly one or a plurality of motion detector subassemblies each of which subassemblies includes one passive infrared (PIR) motion sensor, one Fresnel lens, electric and electronic circuitry and related packaging. In another aspect of the present invention, a photoelectric cell is added to prevent electrical current from reaching the electrical lamp when sufficient ambient light exists. In yet another aspect, an electronic timer is added to turn off the light after a configurable period of time.

In still another aspect of the present invention, the motion detector subassembly, the photoelectric cell subassembly and the electronic timer are disposed on the decorative trim for a recessed light assembly. In this manner, an existing recessed lighting fixture can be upgraded to have a motion detection facility by simply removing the existing decorative trim and replacing it with the decorative trim described in this disclosure.

BRIEF DESCRIPTION OF THE DRAWINGS

To further elaborate to those skilled in the art, the present invention, its numerous objects, features, advantages, and its preferred and some of its alternate embodiments are illustrated with reference to the accompanying drawings.

DETAILED DESCRIPTION OF THE INVENTION

The following detailed description of the present invention provides specifics of some of the possible embodiments of the invention. The description of these embodiments merely illustrates the invention and these are by no means the only embodiments of the present invention, nor should their description be construed to be limiting in that regard.

Figure 1:
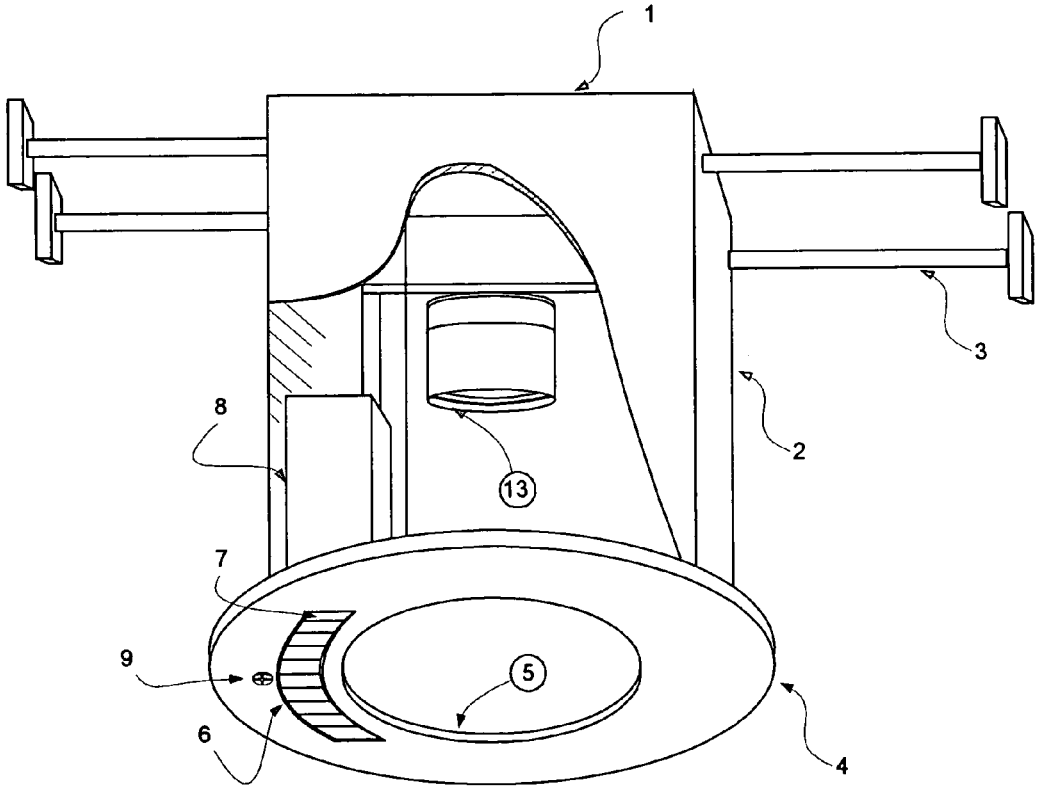
FIG. 1 is a perspective view of a recessed light assembly of the present invention, illustrated with hangers that are suitable for mounting the assembly between structural joists.

A decorative recessed light assembly adapted to utilize a motion detection system in accordance with the present invention is illustrated in FIG. 1. The Recessed Light Assembly, generically referenced by numeral 1, generally includes a housing canister 2 typically of galvanized steel frame, hanger bars 3, an annular decorative trim 4 that has an aperture 5 that allows access for placing an electrical lamp into lamp socket 13, and yet another aperture 6 for optical subassembly 7 of a motion detector subassembly 8. Other embodiments of this invention may also comprise a reflector (not shown) inside the housing canister 2 and a glass dome (not shown) in the center of the decorative trim 4.

In yet other embodiments, housing canister 2 may have a different cross-section, such as rectangular or square. The hanger bars 3 may be of cantilever design to suit the structural and architectural requirements. In some embodiments, decorative trim 4 may comprise multiple segments and could be rectangular, square, or of some other decorative design to suit specific consumer and architectural needs.

In the embodiment shown in FIG. 1, decorative trim 4 is generally of a convexo-concave or plano-concave cross-section. Aperture 6 in decorative trim 4 is of a size and shape designed to provide a cutout with proper tolerances for optical subsystem 7 of motion detector subassembly 8 to fit in. Optical subsystem 7 generally comprises a focusing lens for infrared radiation and may also comprise a decorative shield that may additionally offer weather proofing for the infrared motion detection subassembly while at the same time said decorative shield does not obstruct infrared radiation from passing through. For reasons of aesthetics, the decorative shield (not shown) is aligned and coplanar with the external surface of decorative trim 4. Where a decorative shield is used, it is preferably of a color and texture matching that of decorative trim 4.

Figure 5:
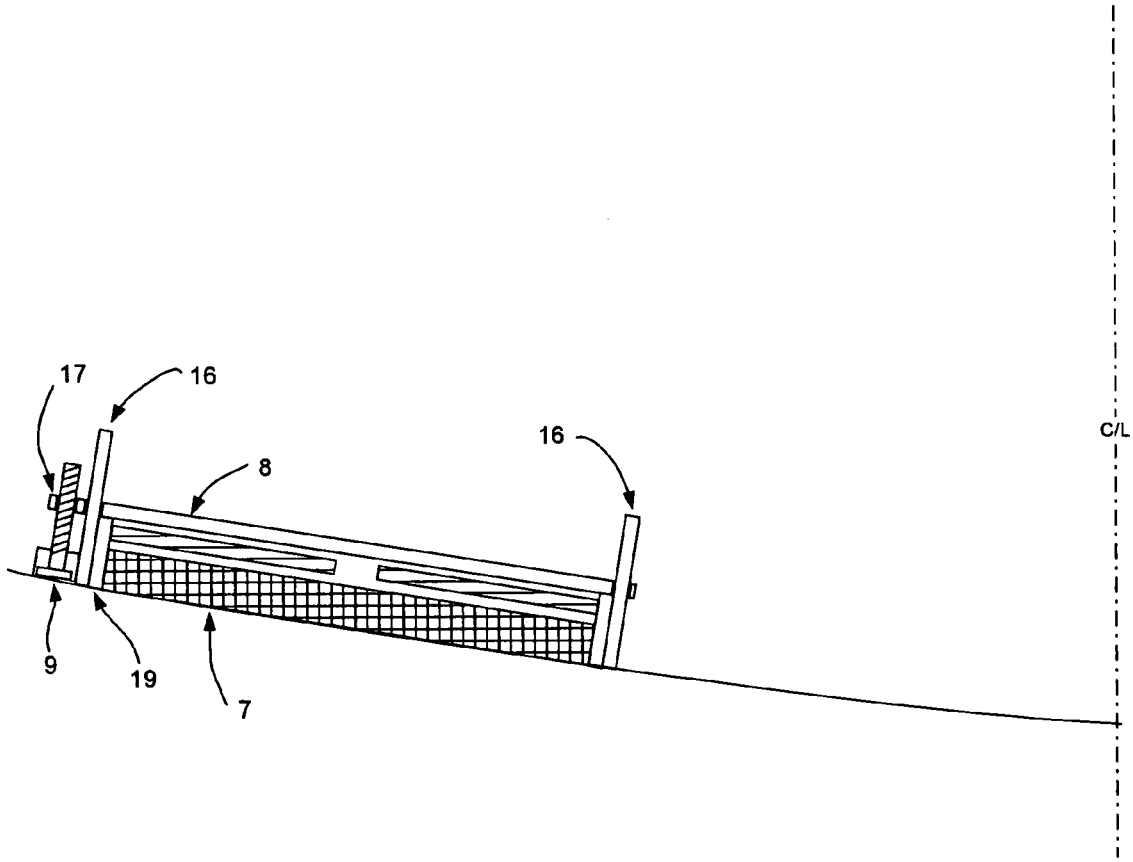
FIG. 5 shows a detailed view of the motion detector subassembly that also shows a photoelectric cell, the focusing device (lens) and a positioning screw for mechanical adjustment of field of view of the focusing device.

The field of view of the optical subsystem 7 can be manipulated using positioning screw 9 that slidingly moves the motion detector subassembly 8 along guides 16 shown in FIG. 5. Moving the motion detector subassembly 8 along guides 16 adjusts the position of the optical subsystem 7 with respect to decorative trim 4, thereby positioning the optics to stand out from decorative trim 4, thus providing a larger field of view. Photoelectric cell 19, shown in FIG. 5 and not shown in FIG. 1, provides an additional logic control inserted in the path of line electrical current flow to lamp socket 13. When armed through a user-accessible control switch (not shown), photoelectric cell 19 detects ambient lighting condition to generate a corresponding small amount of electrical current. A decision logic circuit in conjunction with motion detector subassembly 8 uses said small electrical current to release or stop the flow of line electrical current to lamp socket 13. This mechanism prevents the lamp from turning on when sufficient ambient light would preclude the need for electrical lighting.

Figure 2:
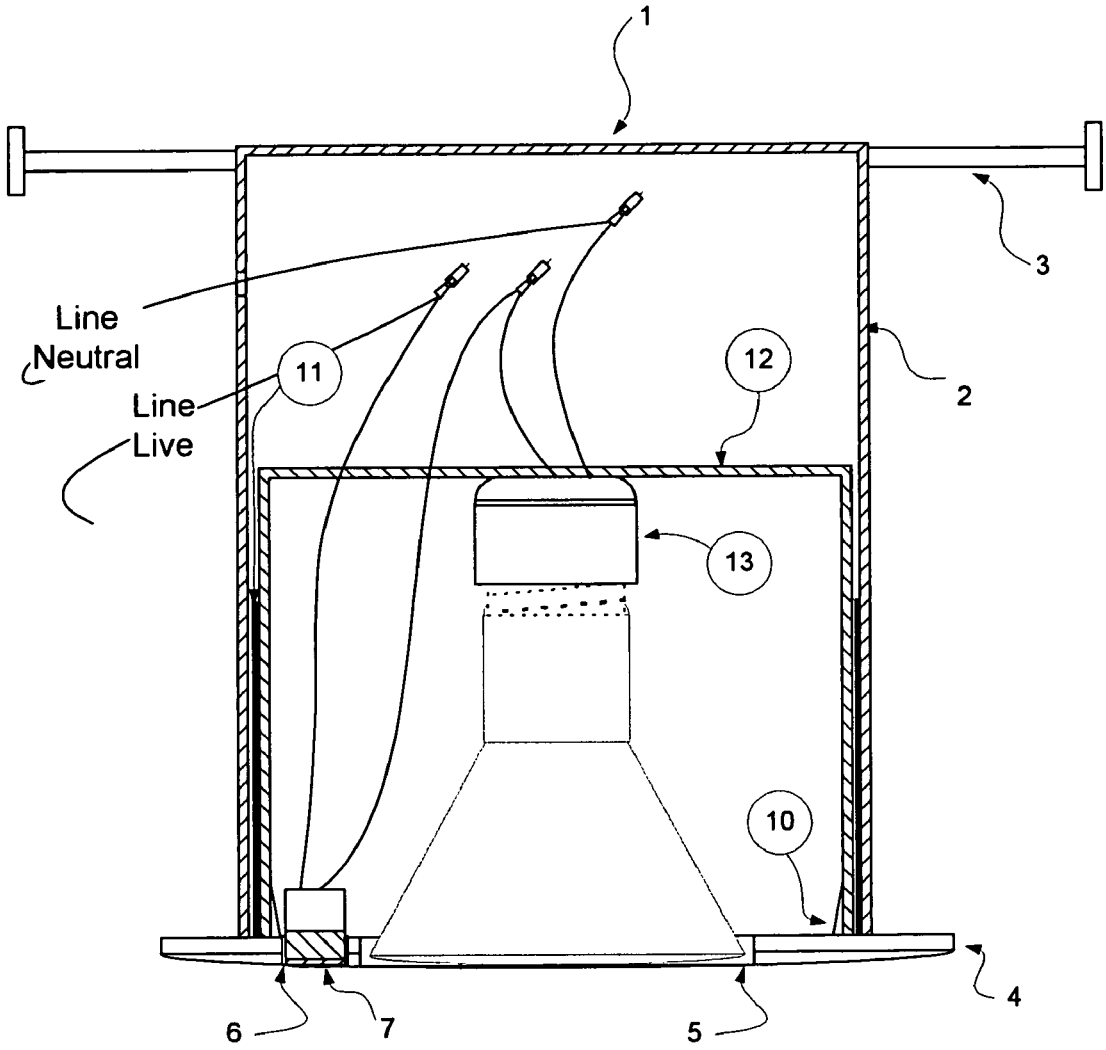
FIG. 2 is a cross-sectional view of the recessed light assembly illustrated in FIG. 1.

FIG. 2 shows a cross-section of the embodiment selected to illustrate the present invention in FIG. 1. Lamp socket frame 12 comprises an inverted u-shaped metallic frame structure with an electric lamp socket 13. Decorative trim 4 has a plurality of locking tab 10 and a plurality of retaining spring 11, which retaining springs 11 are of a cantilever spring type. Socket frame 12 snaps and locks into locking tabs 10 on decorative trim 4, with retaining springs 11 staying on the outer side of socket frame 12. This subassembly comprising the electrical lamp frame 13 and decorative trim 4 is further explained in FIG. 3. When inserted into housing canister 2 as depicted in FIG. 2, retaining springs 11 are retained inside housing canister 2 under spring loading, thus becoming locked therein. Completed Recessed Light Assembly 1 is installed in a cavity using hanger bars 3, if installing between joists. The use of hanger bars 3 is not limiting in that, depending on specific structural requirements, a cantilever hanger or some other means can be used to mount the Recessed Light Assembly 1.

Figure 3:
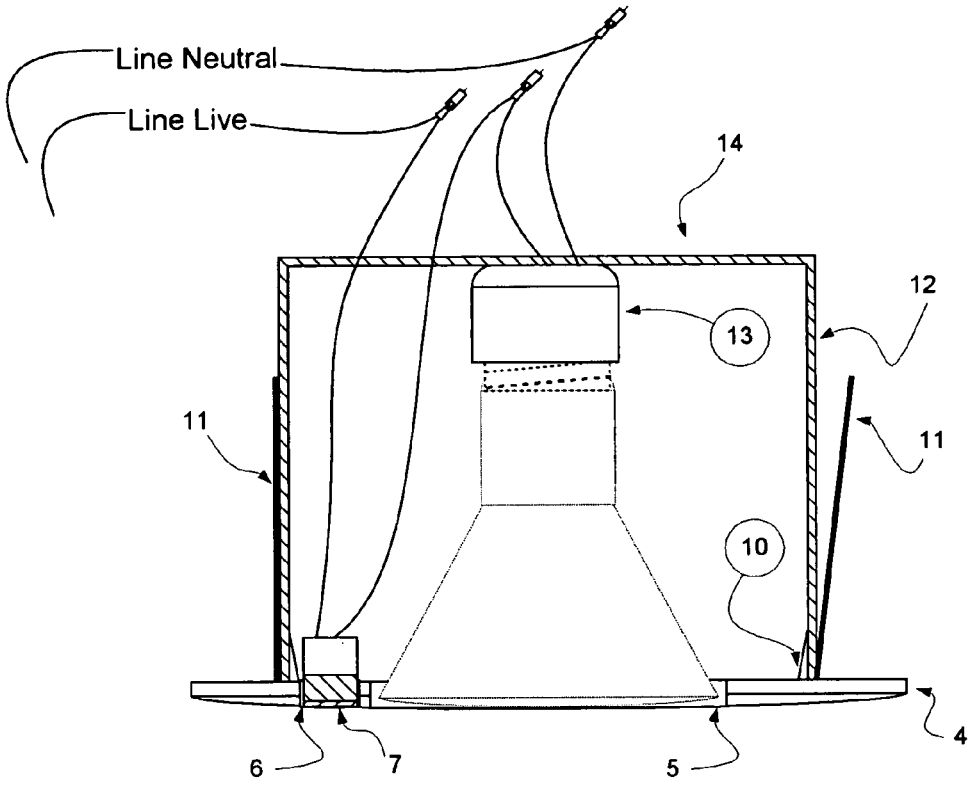
FIG. 3 is another cross-sectional view of the recessed light assembly without the housing canister that is shown for the recessed light assembly of FIG. 2.

Another embodiment of the present invention is depicted in FIG. 3. When installing the object of present invention into an existing recess designed for a light fixture, an insulated metal housing canister, such as the one depicted in FIGS. 1 & 2 as housing canister 2, may already be in place. For such installations, the embodiment of the present invention depicted in FIG. 3 provides a Slidable Recessed Light Assembly 14 that is derived from the Recessed Light Assembly 1 by removing from the latter the housing canister 2 and hanger bars 3. Under spring load of retaining springs 11, Slidable Recessed Light Assembly 14 inserts and locks into the pre-existing housing canister.

Figure 4:
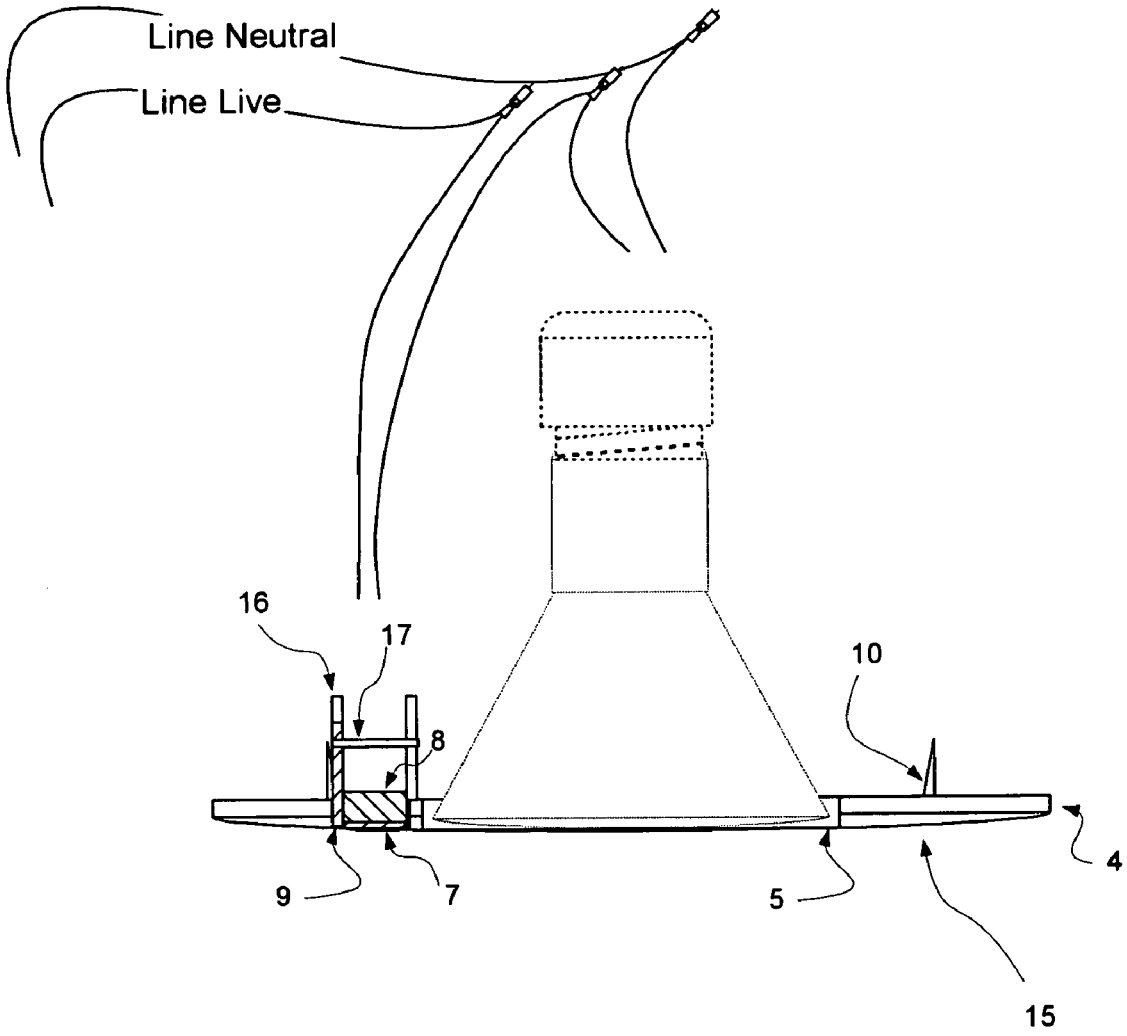
FIG. 4 is a yet another cross-sectional view of the recessed light assembly of FIG. 2 without the housing canister and without the electrical lamp socket frame shown for the recessed light assembly of FIG. 2.

FIG. 4 illustrates yet another embodiment of the present invention wherein for some specific recessed lighting applications, socket frame 12 has been removed from Slidable Recessed Light Assembly 14 depicted in FIG. 3. This results in a Recessed Light Trim and Motion Detector Assembly 15 as shown in FIG. 4, which primarily comprises a decorative trim 4 and a motion detector subassembly 8, and may also comprise (not shown) a photoelectric cell, an electronic timer, and a decorative shield.

FIG. 5 shows the mechanism for the mechanical adjustment of motion detector subassembly 8. With reference to FIGS. 4 & 5, motion detector subassembly 8 slides into and along guides 16. Positioning screw 9 is held in place while it threads into collar 17, which collar 17 is part of and stands out from the motion detector subassembly 8. Turning positioning screw 9 provides manual positional adjustments of the combination of the optical subsystem 7 and motion detector subassembly 8 so as to achieve desired field of view at the time and site of installation. The same mechanism is usable in all embodiments illustrated in this disclosure—the Recessed Light Assembly 1, Slidable Recessed Light Assembly 14, and Recessed Light Trim and Motion Detector Assembly 15.

Figure 6:
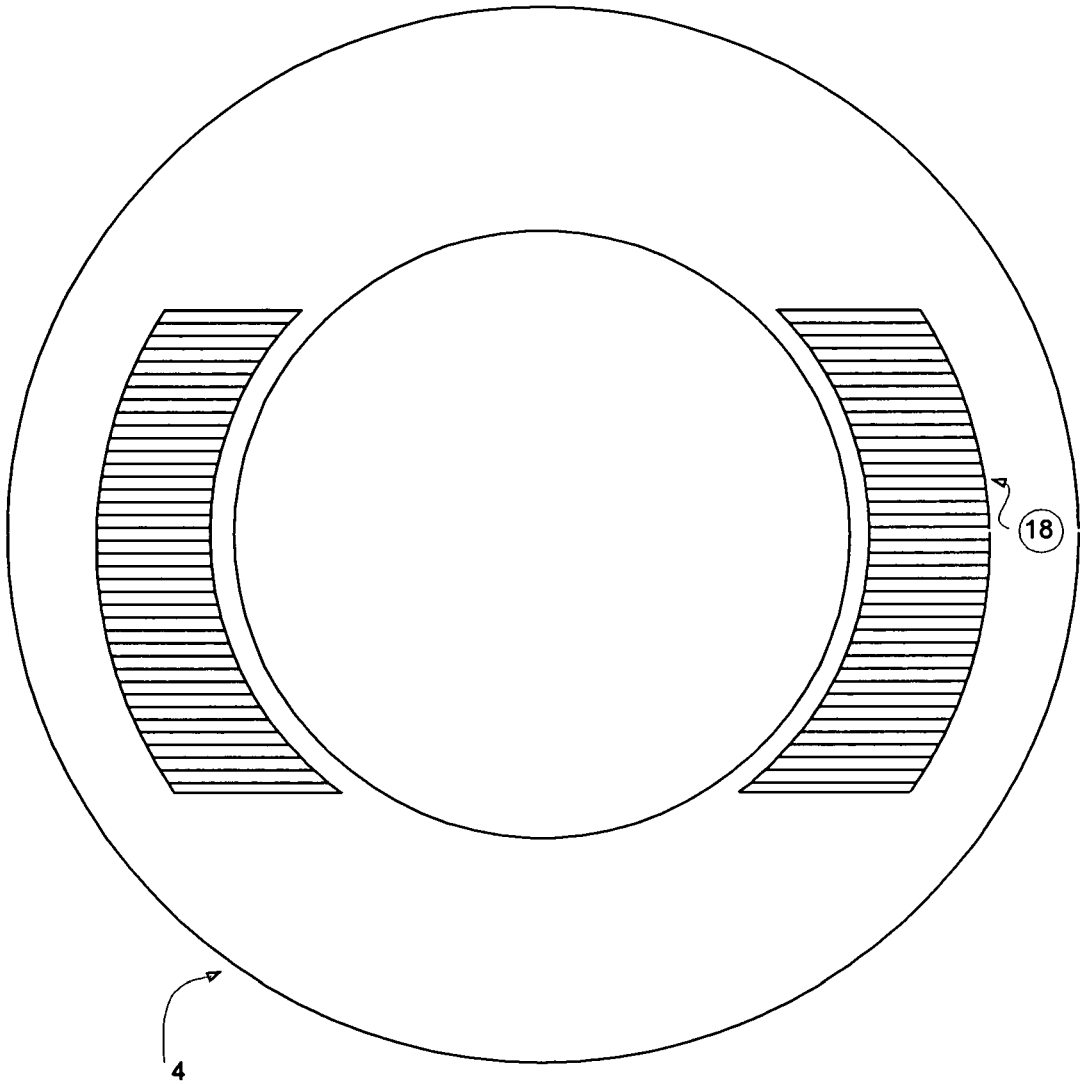
FIG. 6 is a plan view of the recessed light assembly of FIG. 2, showing two motion detector subassemblies rather than one.

The single motion detector in the illustrated embodiments generally provides good area coverage over the entire 360-degree field of view under most conditions, with coverage range from the center of the optical subassembly 7 tracing an elliptical zone for the measurement of infrared radiation energy, rather than a circular zone. A second motion detector subassembly 18 shown in FIG. 6 may be added to provide improved distance coverage on all sides.

In yet other embodiments of the present invention, the focusing lens, motion detector sensors, timer and the electronic circuitry are placed directly on the decorative trim 4, without the need for a separate mounting subassembly that is shown for other embodiments in FIGS. 1, 2, 3, 4 and 5. The dimensions of the focusing lens and its focus length are so selected as to make the package fit within the cavity of the concave side of decorative trim 4, and the electronic circuit is etched directly on decorative trim 4.

Motion detector subassembly 8 is generally constructed in two parts which two parts are (a) PIR electronics and (b) a focusing device. Further description of the internals of motion detector subassembly 8 and its sub-components, and the workings of PIR electronics and focusing devices is outside the scope of this disclosure. Components, such as motion detectors, photoelectric cells, and lamp sockets, referenced above to illustrate the present invention are generally commercially available to meet specific requirements.

It should be understood that the above description is for the particular embodiments of the invention chosen primarily to elaborate the design and advantages of the present invention. Changes and alterations to embodiments can be made without departing from the spirit and the broader aspects and objectives thereof as set forth in the appended claims.

I claim:

1. A recessed light assembly adapted to use motion detector(s) tuned to detect human and/or animal motion and consequently turn the recessed light on, the recessed light assembly comprising:

a housing canister for recessed light and further comprising means of mounting said housing to structural elements;

a decorative trim (bezel) with apertures for electric lamp and motion detector mechanism, and configured to fit with said recessed light assembly;

one or more motion detector(s), each disposed along an aperture in said decorative trim and comprising:

radiation sensors;

radiation bandwidth filtration mechanism;

means to focus radiation over radiation sensors; and logic circuits;

an electrical socket frame comprising an electrical lamp socket, disposed over said decorative trim, and designed to fit within the housing canister of said recessed lighting assembly; and electrical cabling designed to place motion detector(s) between source line voltage and electric lamp socket in recessed light assembly.

2. A recessed light assembly as claimed in claim 1, and further comprising:

an ambient light detection mechanism that is designed to prevent electrical power from being applied to electric lamp recited in claim 1 when a configurable amount of ambient light, the term configurable encompassing the range between there being no configurability at all to a configurability to a certain level of sensitivity to infrared radiation changes, is present.

3. A recessed light assembly as claimed in claim 1, and further comprising:

a timer that, after a configurable period of time, the term configurable encompassing the range between there being no configurability at all to a configurability to certain number of seconds, disconnects electrical power being applied to electric lamp recited in claim 1.

4. A recessed light assembly as claimed in claim 1, and further comprising:

an ambient light detection mechanism that prevents electrical power from being applied to electric lamp recited in claim 1 when a configurable amount of ambient light, the term configurable encompassing the range between there being no configurability at all to a configurability to a certain level of sensitivity to infrared radiation changes, is present; and a timer that, after a configurable period of time, the term configurable encompassing the range between there being no configurability at all to a configurability to certain number of seconds, disconnects electrical power being applied to electric lamp recited in claim 1.

5. A recessed light assembly as claimed in claim 1, albeit without the housing canister recited in claim 1, the resulting subassembly so designed as to fit and retain itself into a matching recessed light housing canister.

6. A recessed light assembly as claimed in claim 1, albeit without the housing canister recited in claim 1, the resulting subassembly so designed as to fit and retain itself into a matching recessed light housing canister, the resulting subassembly further comprising:

an ambient light detection mechanism that prevents electrical power from being applied to electric lamp recited in claim 1 when a configurable amount of ambient light, the term configurable encompassing the range between there being no configurability at all to a configurability to a certain level of sensitivity to infrared radiation changes, is present.

7. A recessed light assembly as claimed in claim 1, albeit without the housing canister recited in claim 1, the resulting subassembly so designed as to fit and retain itself into a matching recessed light housing canister, the resulting subassembly further comprising:

a timer that, after a configurable period of time, the term configurable encompassing the range between there being no configurability at all to a configurability to certain number of seconds, disconnects electrical power being applied to electric lamp disclosed in claim 1.

8. A recessed light assembly as claimed in claim 1, albeit without the housing canister recited in claim 1, the resulting subassembly so designed as to fit and retain itself into a matching recessed light housing canister, the resulting subassembly further comprising:

an ambient light detection mechanism that prevents electrical power from being applied to electric lamp recited in claim 1 when a configurable amount of ambient light, the term configurable encompassing the range between there being no configurability at all to a configurability to a certain level of sensitivity to infrared radiation changes, is present; and a timer that, after a configurable period of time, the term configurable encompassing the range between there being no configurability at all to a configurability to certain number of seconds, disconnects electrical power being applied to electric lamp recited in claim 1.

9. A decorative trim subassembly for a recessed light assembly adapted to use motion detector(s) tuned to detect human and/or animal motion and consequently turn the recessed light on, the decorative trim subassembly comprising:

an annular decorative trim plate (bezel) with apertures for electric lamp and motion detector mechanism, and designed to fit and retain itself in a matching recessed light assembly;

one or more motion detector(s), each disposed along an aperture in said decorative trim plate and comprising:
radiation sensors;
radiation bandwidth filtration mechanism;
means to focus radiation over radiation sensors; and
logic circuits;

electrical cabling designed to place motion detector(s) between source line voltage and electric lamp socket in the recessed light assembly.

10. A decorative trim subassembly for a recessed light assembly as claimed in claim 9, and further comprising:

an ambient light detection mechanism that prevents electrical power from being applied to electric lamp disclosed in claim 9 when a configurable amount of ambient light, the term configurable encompassing the range between there being no configurability at all to a configurability to a certain level of sensitivity to infrared radiation changes, is present.

11. A decorative trim subassembly for a recessed light assembly as claimed in claim 9, and further comprising:

a timer that, after a configurable period of time, the term configurable encompassing the range between there being no configurability at all to a configurability to certain number of seconds, disconnects electrical power being applied to electric lamp disclosed in claim 9.

12. A decorative trim subassembly for a recessed light assembly as claimed in claim 9, and further comprising:

an ambient light detection mechanism that prevents electrical power from being applied to electric lamp disclosed in claim 9 when a configurable amount of ambient light, the term configurable encompassing the range between there being no configurability at all to a configurability to a certain level of sensitivity to infrared radiation changes, is present; and a timer that, after a configurable period of time, the term configurable encompassing the range between there being no configurability at all to a configurability to certain number of seconds, disconnects electrical power being applied to electric lamp disclosed in claim 9.

13. A decorative trim subassembly for a recessed light assembly adapted to use motion detector(s) tuned to detect human and/or animal motion and consequently turn the recessed light on, the decorative trim subassembly comprising:

an annular decorative trim plate (bezel) with apertures for electric lamp and motion detector mechanism, and designed to fit and retain itself in a matching recessed light assembly;

one or more motion detector(s), each surface mounted on said decorative trim plate and along an aperture in said decorative trim plate and comprising:
surface mounted radiation sensors surface;
surface mounted radiation bandwidth filtration mechanism;
means to focus radiation over radiation sensors; and
logic circuit etched directly on said decorative trim;

electrical cabling designed to place motion detector(s) between source line voltage and electric lamp in the recessed light assembly.

14. A decorative trim subassembly for a recessed light assembly as claimed in claim 13, and further comprising:

an ambient light detection mechanism that prevents electrical power from being applied to electric lamp disclosed in claim 13 when a configurable amount of ambient light, the term configurable encompassing the range between there being no configurability at all to a configurability to a certain level of sensitivity to infrared radiation changes, is present.

15. A decorative trim subassembly for a recessed light assembly as claimed in claim 13, and further comprising:

a timer that, after a configurable period of time, the term configurable encompassing the range between there being no configurability at all to a configurability to certain number of seconds, disconnects electrical power being applied to electric lamp disclosed in claim 13.

16. A decorative trim subassembly for a recessed light assembly as claimed in claim 13, and further comprising:

an ambient light detection mechanism that prevents electrical power from being applied to electric lamp disclosed in claim 13 when a configurable amount of ambient light, the term configurable encompassing the range between there being no configurability at all to a configurability to a certain level of sensitivity to infrared radiation changes, is present; and a timer that, after a configurable period of time, the term configurable encompassing the range between there being no configurability at all to a configurability to certain number of seconds, disconnects electrical power being applied to electric lamp disclosed in claim 13.

* * * * *